US011499303B1

(12) United States Patent
Tobin

(10) Patent No.: US 11,499,303 B1
(45) Date of Patent: Nov. 15, 2022

(54) WATER SAVING TOILET TANK DAM

(71) Applicant: Patrick Tobin, San Diego, CA (US)

(72) Inventor: Patrick Tobin, San Diego, CA (US)

( * ) Notice: Subject to any disclaimer, the term of this patent is extended or adjusted under 35 U.S.C. 154(b) by 0 days.

(21) Appl. No.: 17/478,131

(22) Filed: Sep. 17, 2021

(51) Int. Cl.
*E03D 1/012* (2006.01)

(52) U.S. Cl.
CPC ..... *E03D 1/012* (2013.01)

(58) Field of Classification Search
CPC ..... E03D 1/12; E03D 1/14
USPC ..... 4/415, 345, 346, 363
See application file for complete search history.

(56) References Cited

U.S. PATENT DOCUMENTS 3,790,967 A * 2/1974 Pignato ..... E03D 11/146 4/358
3,811,134 A 5/1974 Throckmorton et al.
3,812,544 A * 5/1974 Risley ..... E03D 1/22 4/353
3,820,170 A 6/1974 Kern et al.
4,009,497 A * 3/1977 Moon ..... E03D 1/22 4/378
4,080,667 A 3/1978 Walsh et al.
4,144,600 A 3/1979 Mayes
D252,403 S 7/1979 Baron
D252,765 S 8/1979 Ziolkawski
4,225,985 A 10/1980 Joshi et al.
4,250,579 A 2/1981 Moon
4,388,737 A 6/1983 Wenzel
4,543,674 A * 10/1985 David ..... E03D 1/00 4/353
5,067,180 A 11/1991 Figeroid
5,259,075 A 11/1993 Cutler
7,810,178 B2 10/2010 Wajda
8,239,976 B2 8/2012 Chen et al.
2008/0034488 A1 2/2008 Lusch
2014/0304907 A1 * 10/2014 Roberts, Jr. ..... A47K 3/40 4/613

* cited by examiner

*Primary Examiner* — Christine J Skubinna
(74) *Attorney, Agent, or Firm* — Mridula P. Sherin

(57) ABSTRACT

Provided herein is a water dam device for installation in the water tank of a toilet to reduce the quantity of water discharged from the tank during flushing while maintaining a satisfactory flushing action.

21 Claims, 9 Drawing Sheets

WATER SAVING TOILET TANK DAM

FIELD OF THE INVENTION

The present disclosure provides a device to reduce water consumption from a toilet.

BACKGROUND

The Southwestern United States is in one of the most severe droughts in recent history. As water is one of the world's most precious resource, products that enhance the conservation of water will continue to increase in value.

The single greatest consumer of water in the average household and hotel room is toilet flushes, as much as 24% of water consumption. The action of the flush toilet has not changed since its inception in the 19th century, using the gravitational flow force of the water in the tank (or reservoir) to evacuate the bowl. While today's tanks are becoming smaller and more water efficient, there are tens of millions of toilets in the drought impacted area that are older and consume as much as 2 gallons of water per flush. The bowl evacuation is actuated by the gravitational weight of the water in the tank.

Accordingly, there is a need for a device that adapts to different manufacturer tank designs and dimensions, thereby retrofitting older toilet tanks into efficient toilet tanks.

SUMMARY

The present disclosure provides a device that holds back (or dams) a percentage of the water in a toilet bowl whereby the flush action will still be sufficient to evacuate the bowl with a reduction in the amount of water necessary to refill the tank.

It is known that adequate flushing of a toilet depends on a so-called "siphon effect" which creates the downward swirling flow of water in a toilet bowl. The siphon effect in turn is dependent to a large extent on the head of water available. Although attempts have been made to conserve water by reducing the capacity of the tank, such attempts have not been entirely satisfactory. For instance, some attempts contemplate the placement of solid objects in the tank to reduce its volume, and other attempts contemplate the installation of complex apparatus around the drain in the tank. With the foregoing in mind, it is a primary object of the present invention to provide novel means for conserving water used to flush a toilet while maintaining a satisfactory flushing action. It is another object of the present invention to provide for use in a toilet-tank an improved dam device which is capable of being installed readily by an average homeowner without requiring any tools.

In an aspect, provided herein is a water dam device, including a skeleton, the skeleton including a first material; and a pliable casement molded to the skeleton, the pliable casement including a second material, wherein tack of the second material is greater than tack of the first material, the pliable casement including a base portion, a first side, and a second side capable of forming an interference fit (may be referred to as a static seal) with a bottom, a front wall, and a back wall, respectively, of a toilet tank, the toilet tank comprising the bottom, the front wall, and the back wall.

In an aspect, provided herein is a method of manufacturing a water dam device, including forming a skeleton comprising a vertical pillar extending from a top portion to a base portion, a plurality of horizontal extensions from the vertical pillar, and a plurality of vertical extensions from the vertical pillar, and injection molding a pliable casement around the skeleton, the pliable casement comprising a base portion, a first side, and a second side capable of forming an interference fit with a bottom, a front wall, and a back wall, respectively, of a toilet tank, the toilet tank comprising the bottom, the front wall, and the back wall; and wherein the skeleton comprises a first material, wherein the pliable casement comprises a second material, and wherein tack of the second material is greater than tack of the first material.

In an aspect, provided herein is a method of damming water in a toilet tank, the method including fitting a water dam device in a toilet tank, the water dam device including a skeleton, the skeleton including a first material, and a pliable casement molded to the skeleton, the pliable casement including a second material, wherein tack of the second material is greater than tack of the first material, the pliable casement comprising a base portion, a first side, and a second side.

BRIEF DESCRIPTION OF THE DRAWINGS

The accompanying drawing(s), which are incorporated in and constitute a part of this specification, illustrate several aspects described below.

FIG. 1A is a toilet with a float ball device. FIG. 1B is a toilet with a vertical float.

FIG. 3A is a perspective of a first face of the water dam device showing the skeleton. FIG. 3B is a perspective showing a second face of the water dam device showing the pliable casement.

FIG. 6A shows a top view of the water dam device placed in the toilet tank and as viewed from above looking down into the tank. FIG. 6B is a frontal cut-away view of the water dam device placed in the tank and as viewed from the front of the toilet tank. FIG. 6C is an angled top perspective of the water dam device placed in the tank and as viewed from above and at an angle. All parts of the toilet tank are not shown.

DETAILED DESCRIPTION

Figure 1A:
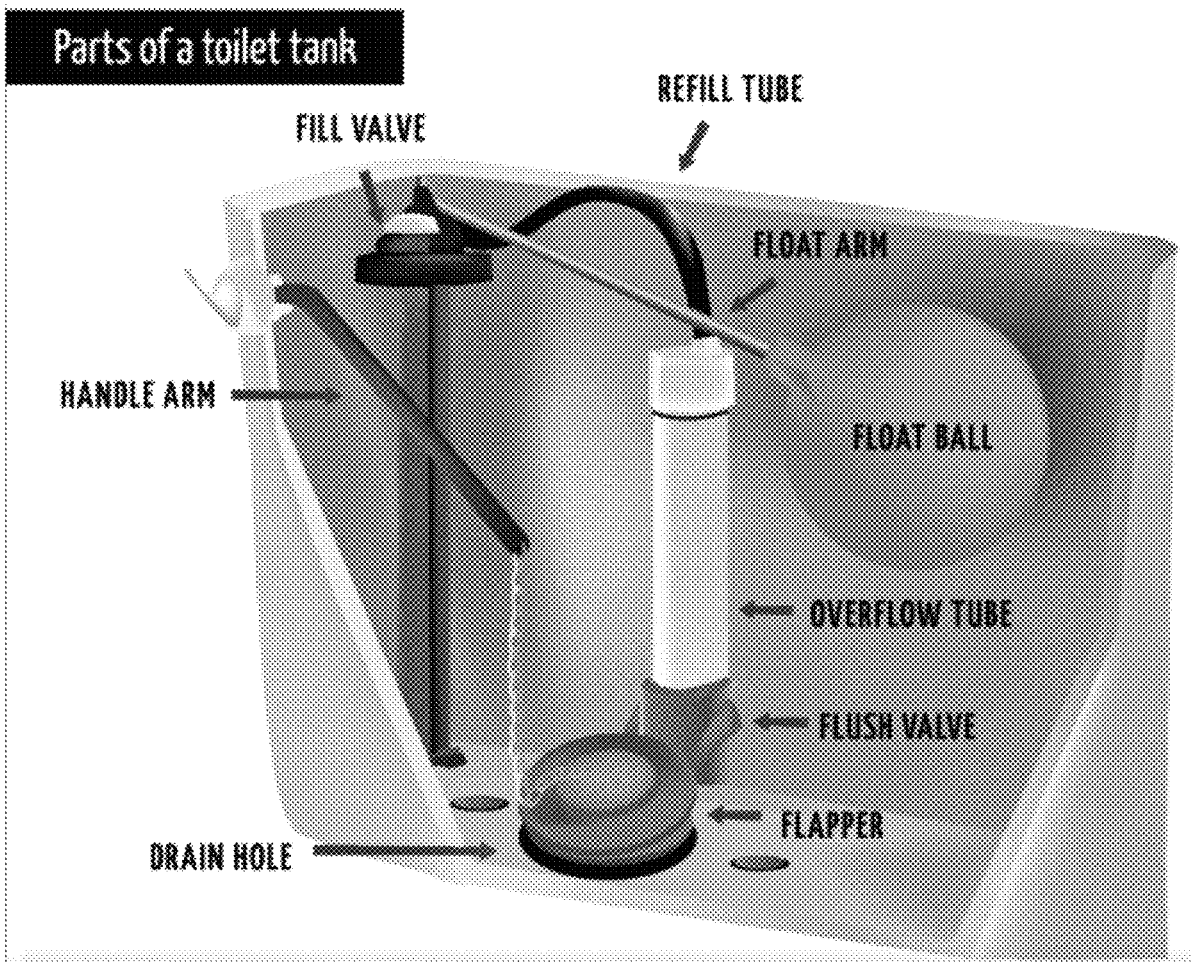
FIGS. 1A-B are views of a standard toilet with various elements labelled.

It is to be understood that this invention is not limited to particular embodiments described, as such may, of course, vary. It is also to be understood that the terminology used herein is for the purpose of describing particular embodiments only, and is not intended to be limiting, since the scope of this invention will be limited only by the appended claims.

The detailed description of the invention is divided into various sections only for the reader's convenience and disclosure found in any section may be combined with that in another section. Unless defined otherwise, all technical and scientific terms used herein have the same meaning as commonly understood by one of ordinary skill in the art to which this invention belongs.

It must be noted that as used herein and in the appended claims, the singular forms "a", "an", and "the" include plural referents unless the context clearly dictates otherwise. Thus, for example, reference to "a compound" includes a plurality of compounds.

I. Definitions

Unless defined otherwise, all technical and scientific terms used herein have the same meaning as commonly understood by one of ordinary skill in the art to which this invention belongs. As used herein the following terms have the following meanings.

The term "about" when used before a numerical designation, e.g., temperature, time, amount, concentration, and such other, including a range, indicates approximations which may vary by (+) or (−) 10%, 5% or 1%, or any subrange or subvalue there between.

"Comprising" or "comprises" is intended to mean that the compositions and methods include the recited elements, but not excluding others. "Consisting essentially of" when used to define compositions and methods, shall mean excluding other elements of any essential significance to the combination for the stated purpose. Thus, a device or method consisting essentially of the elements as defined herein would not exclude other materials or steps that do not materially affect the basic and novel characteristic(s) of the claimed invention. "Consisting of" shall mean excluding more than trace elements of other ingredients and substantial method steps. Embodiments defined by each of these transition terms are within the scope of this invention.

As used herein, the term "polypropylene" is used according to its plain and ordinary meaning and refers to also known as polypropene, is a thermoplastic polymer used in a wide variety of applications. It is produced via chain-growth polymerization from the monomer propylene. Polypropylene belongs to the group of polyolefins and is partially crystalline and non-polar. Its properties are similar to polyethylene, but it is slightly harder and more heat resistant. It is a white, mechanically rugged material and has a high chemical resistance.

As used herein, the term "thermoplastic elastomer", "TPE", and "thermoplastic rubbers" are used according to their plain and ordinary meaning and refer to a class of copolymers or a physical mix of polymers (usually a plastic and a rubber) that consist of materials with both thermoplastic and elastomeric properties. While most elastomers are thermosets, thermoplastics are in contrast relatively easy to use in manufacturing, for example, by injection molding. Thermoplastic elastomers show advantages typical of both rubbery materials and plastic materials. The benefit of using thermoplastic elastomers is the ability to stretch to moderate elongations and return to its near original shape creating a longer life and better physical range than other materials. The principal difference between thermoset elastomers and thermoplastic elastomers is the type of cross-linking bond in their structures. In fact, crosslinking is a critical structural factor which imparts high elastic properties.

As used herein, the term "EPDM rubber" or "ethylene propylene diene monomer rubber" is used according to its plain and ordinary meaning and refers to a type of synthetic rubber that is used in many applications. EPDM is an M-Class rubber under ASTM standard D-1418; the M class comprises elastomers having a saturated chain of the polyethylene type (the M deriving from the more correct term polymethylene). EPDM is made from ethylene, propylene, and a diene comonomer that enables crosslinking via sulfur vulcanization. The earlier relative of EPDM is EPR, ethylene propylene rubber, that contains no diene units and can only be crosslinked using radical methods such as peroxides. Dienes used in the manufacture of EPDM rubbers are ethylidene norbornene (ENB), dicyclopentadiene (DCPD), and vinyl norbornene (VNB). EPDM is derived from polyethylene into which 45-85 weight percent of propylene have been copolymerized to reduce the formation of the typical polyethylene crystallinity. EPDM is a semi-crystalline material with ethylene-type crystal structures at higher ethylene contents, becoming essentially amorphous at ethylene contents that approach 50 weight percent. EPDM is compatible with polar substances, e.g., fireproof hydraulic fluids, ketones, hot and cold water, and alkalis. It is an electrical insulator.

As used herein, the term "injection molding" is used according to its plain and ordinary meaning and refers to the shaping of rubber or plastic articles by injecting heated material into a mold.

As used herein, the term "contoured edge" refers to a rounded or curved edge.

As used herein, the term "radial arc" refers to a substantially circular of less than 180 degrees. For example, it may circumscribe a portion of a circle.

As used herein, the term "tack" refers to condition when an elastomeric material contacts another surface (normally with force applied), and the elastomeric material deflects and conforms to the mating surface so as to create a static interface.

As used herein, the term "hardness" refers to a measure of the resistance to localized plastic deformation induced by either mechanical indentation or abrasion. In general, different materials differ in their hardness; for example, hard metals such as titanium and beryllium are harder than soft metals such as sodium and metallic tin, or wood and common plastics. Macroscopic hardness is generally characterized by strong intermolecular bonds, but the behavior of solid materials under force is complex; therefore, there are different measurements of hardness: scratch hardness, indentation hardness, and rebound hardness. Hardness is dependent on ductility, elastic stiffness, plasticity, strain, strength, toughness, viscoelasticity, and viscosity.

As used herein, the terms "interference fit", "static seal", "press fit" and "friction fit" may be used interchangeably and refer to a form of fastening between two tight fitting mating parts that produces a joint which is held together by friction after the parts are pushed together.

II. Device

Figure 1B:
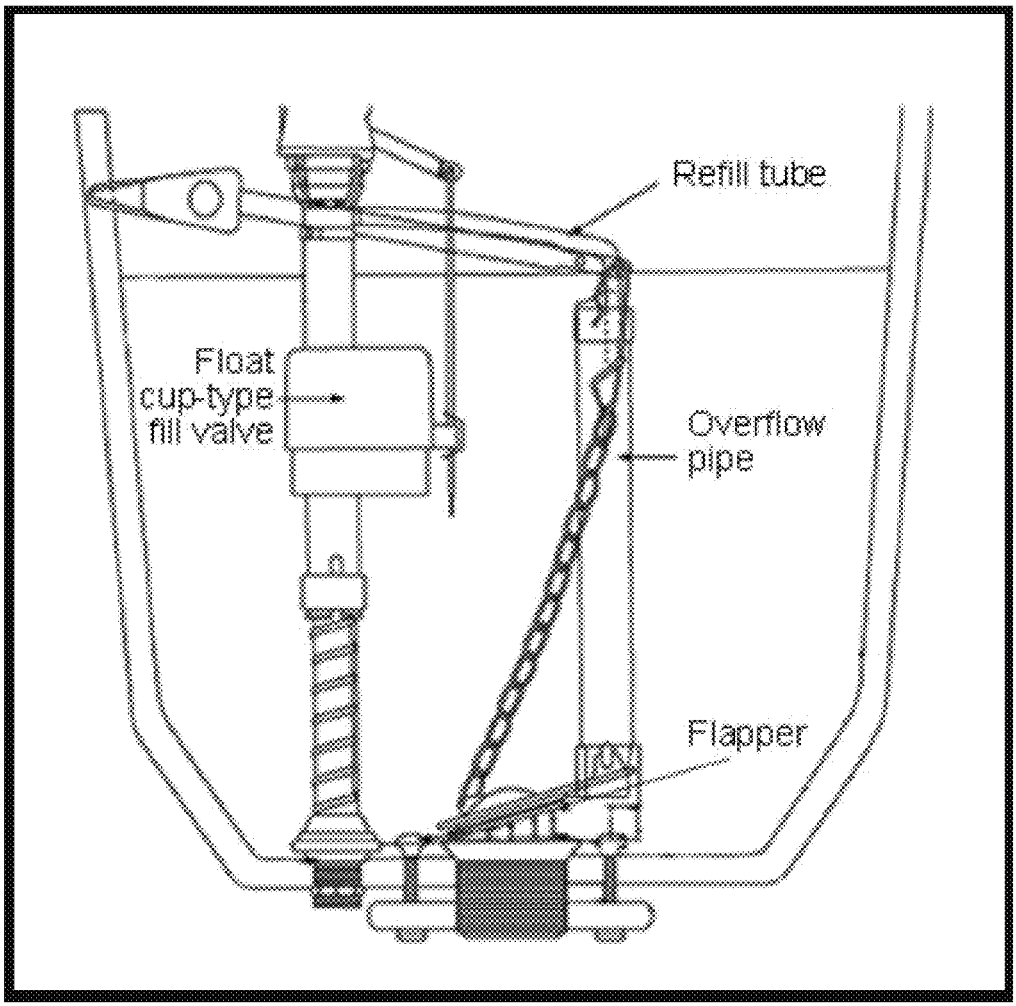

Referring to FIG. 1, there is shown a typical toilet with various parts labelled (reference https://visual.ly/community/infographic/home/how-toilet-flushing-works). FIG. 1A shows a type of toilet tank that utilizes a float ball. In some toilet tanks, the function of the float ball is achieved by vertical float devices as shown in FIG. 1B.

Figure 2:
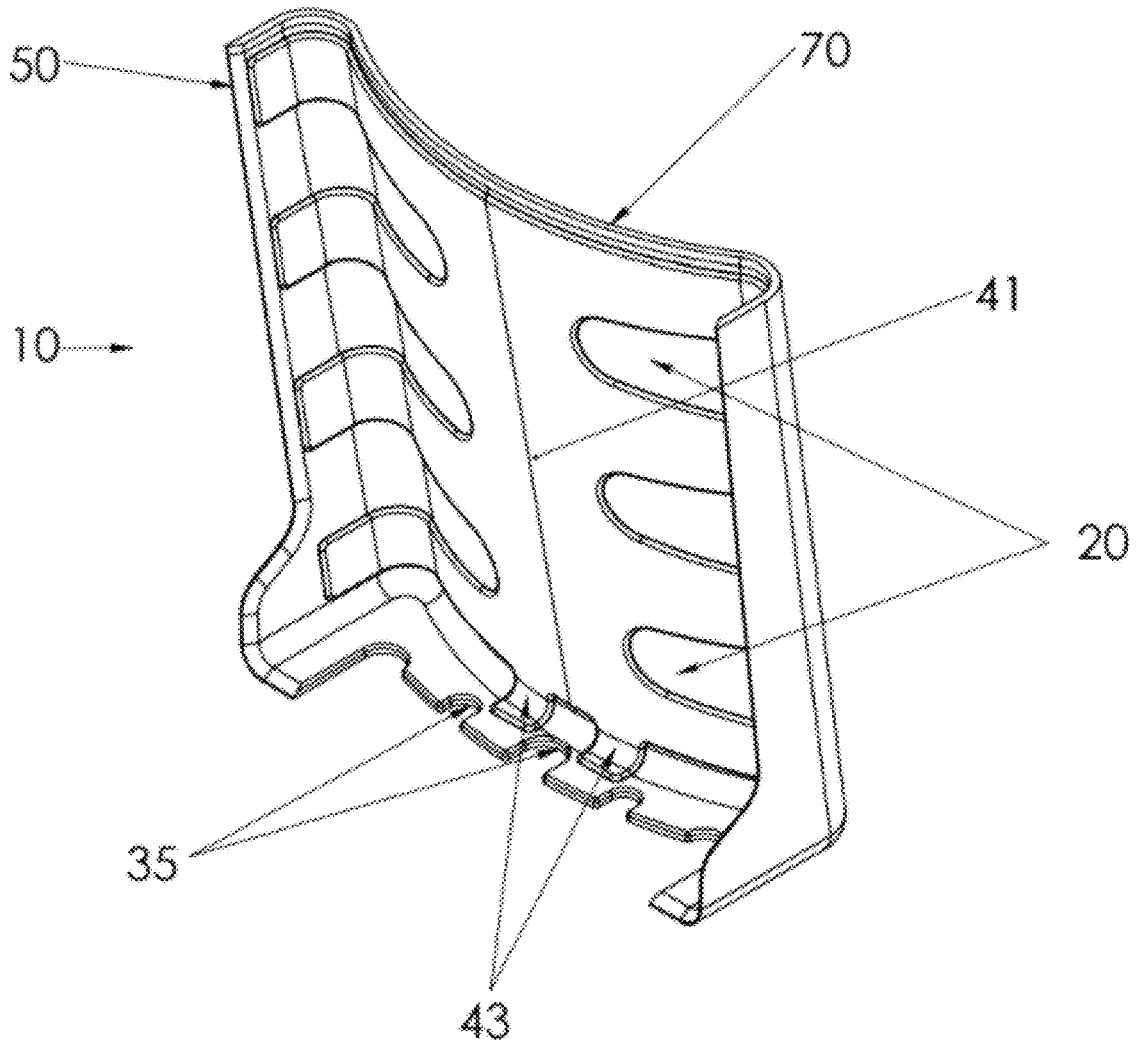
FIG. 2 is a view of the water dam device.

Referring to FIG. 2, there is shown a water dam device (10) having a skeleton (40) (See FIG. 3A) composed of a vertical pillar (41), horizontal extensions from the vertical pillar (42) (See FIG. 3A), and vertical extensions from the pillar (may be referred to as "feet") (43), all integrally molded to a pliable casement (20). The skeleton is designed to maintain the dam position and provide physical structure while the dam holds back a percentage of the water in the tank with each flush. The skeleton (40) (See FIG. 3A) comprises a polypropylene material such as filled polypropylene. The pliable casement (20) comprises a thermoplastic elastomer. Further, the device (10) has a top portion (70), sides (50), and a base portion (30) (See FIG. 4B), where the base portion has cut outs or grooves (35) designed to provide traction against the bottom of the toilet tank and maintain the position of the dam device (10) within the tank.

Figure 3A:
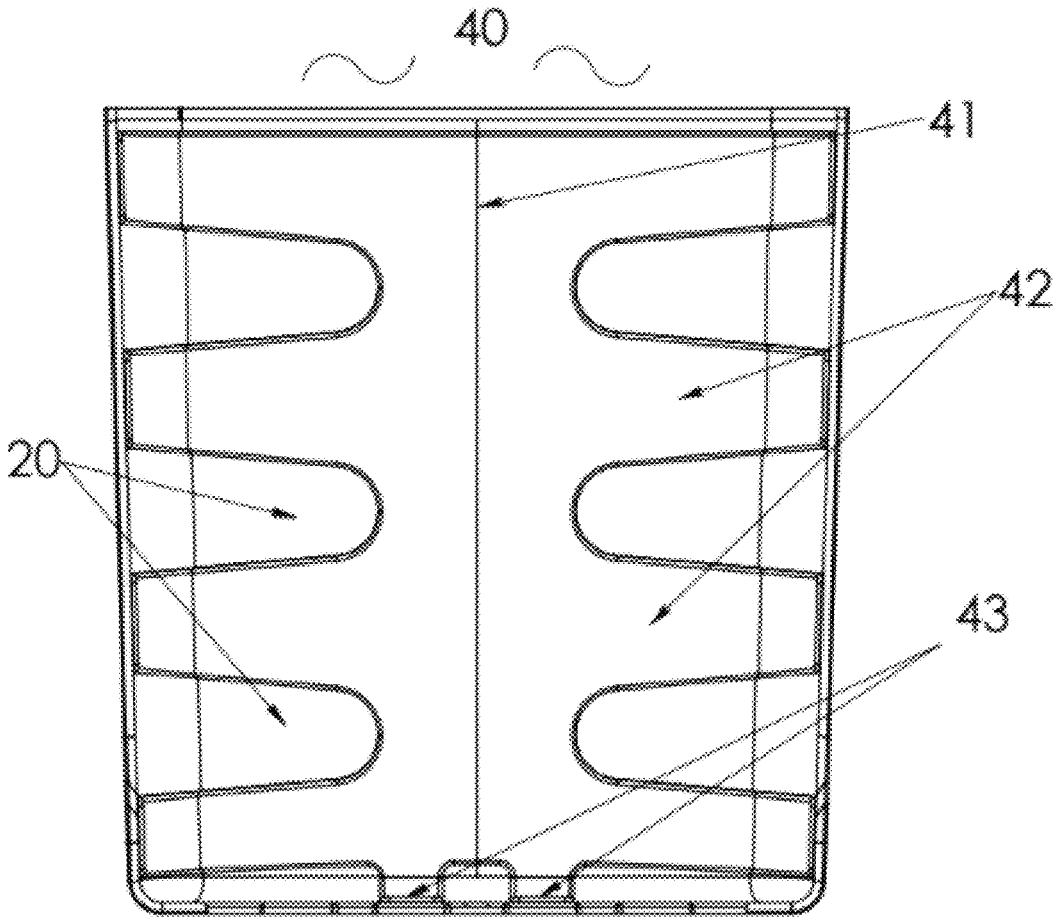
FIGS. 3A-B are views of the water dam device.
Figure 3B:
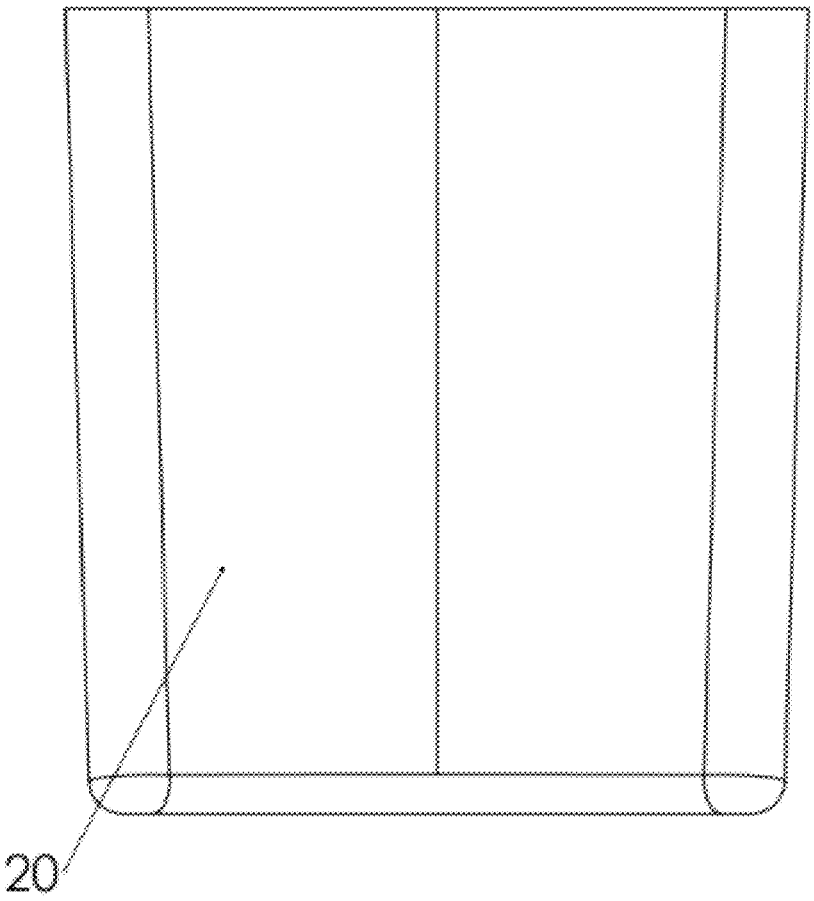

Referring to FIGS. 3A-B, there is shown another view of the water dam device from the side facing the dammed water (FIG. 3A) presenting the skeleton (40) composed of a vertical pillar (41), horizontal extensions from the vertical pillar (42), and vertical extensions from the pillar (may be referred to as "feet") (43) all integrally molded to a pliable casement (20). FIG. 3B shows the opposite side or back face of the dam as compared to FIG. 3A and this side would be facing the water that is flushed, evacuated completely, and refilled. The view in FIG. 3B shows the back face of the device formed by the pliable casement (20).

Figure 4A:
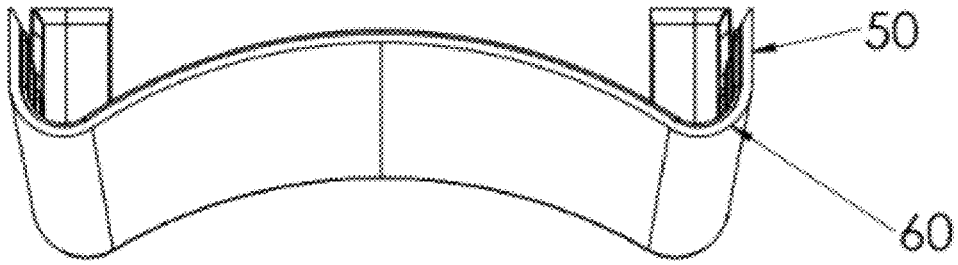
FIGS. 4A-B are perspective views of the base portion of the water dam device as viewed from above (FIG. 4A) showing the side edge and a contoured edge having a radial arc and as viewed from below (FIG. 4B) showing cut-outs.
Figure 4B:
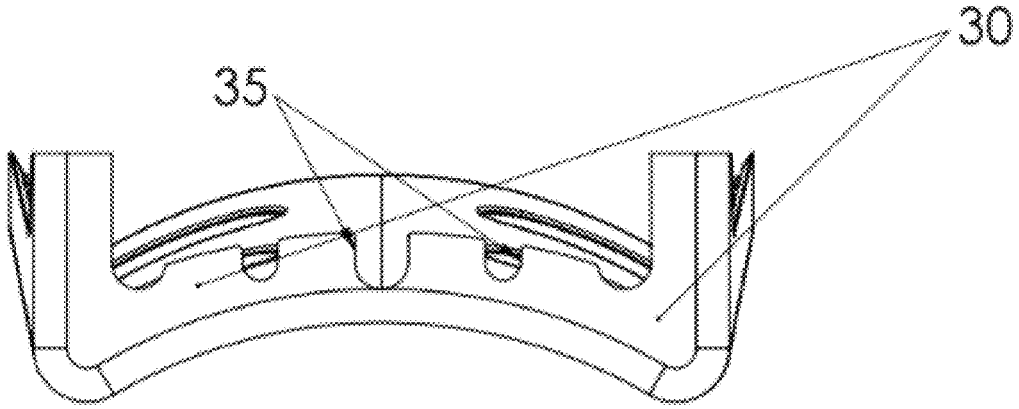

Referring to FIGS. 4A-B, there is shown in FIG. 4A a perspective of the base portion of the device with a side edge (50) shown with a contoured edge (60) as viewed from above. The contoured edge (60) has a radial arc and provides the device the ability to fit the curvature of standard toilet tanks, which inherently vary in width. There is shown in FIG. 4B a perspective of the base portion (30) of the device with cut outs (35) as viewed from below.

Figure 5:
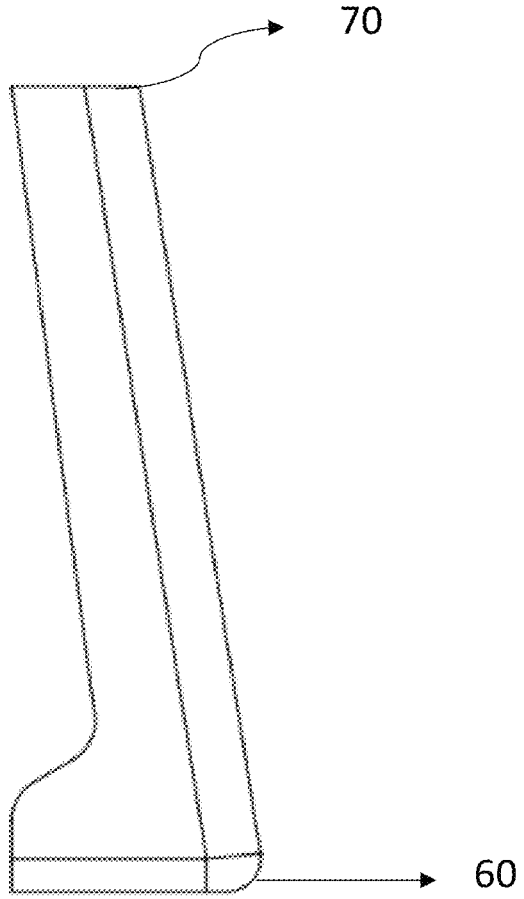
FIG. 5 is a side perspective view of the water dam device showing the top of the dam and a bottom contoured edge having a radial arc.

Referring to FIG. 5, there is shown a side perspective view of the water dam device showing the top of the dam (70) and a contoured edge (60). From the side perspective, the device exhibits an angle which may be about 8 degrees to about 20 degrees. The width of a single cutout (35) (See FIG. 4B) at the bottom portion may be about 5 to about 20 mm. In some embodiments, the width of the entire bottom portion (30) (See FIG. 4B) is about 25 to 100 mm. In an embodiment, the width of the bottom portion (30) is about 55.5 mm.

Referring to FIG. 6, there are shown different perspectives of the water dam device (10) as placed in a toilet tank (80).

Figure 6A:
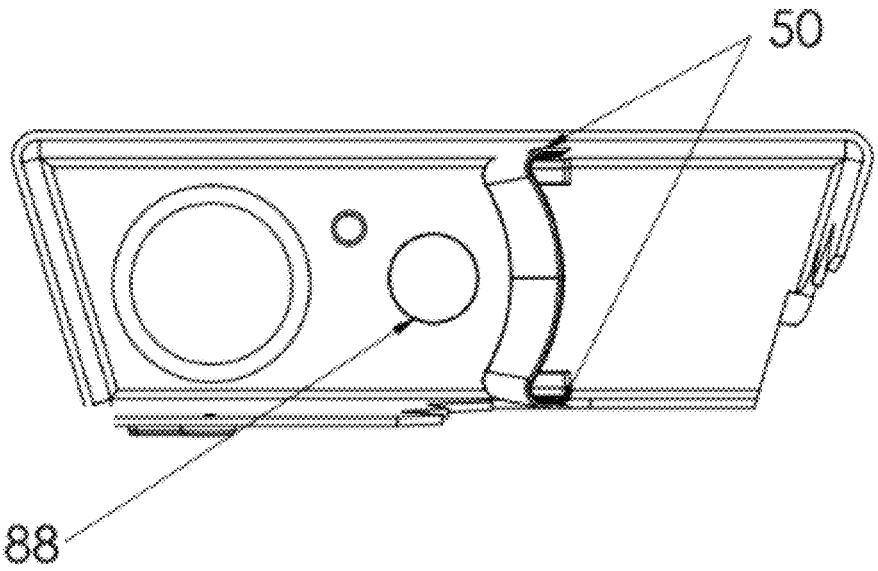
FIGS. 6A-C are different perspective views of the water dam device as placed in a toilet tank.

FIG. 6A is a top view perspective looking down into the toilet tank (80) showing the water dam device (10) placed within the tank such that the sides (50) of the water dam device have an interference fit against the walls of the tank and to a portion of the tank such that the valves and tubes (i.e., flapper (88)) are on one side of the device.

Figure 6B:
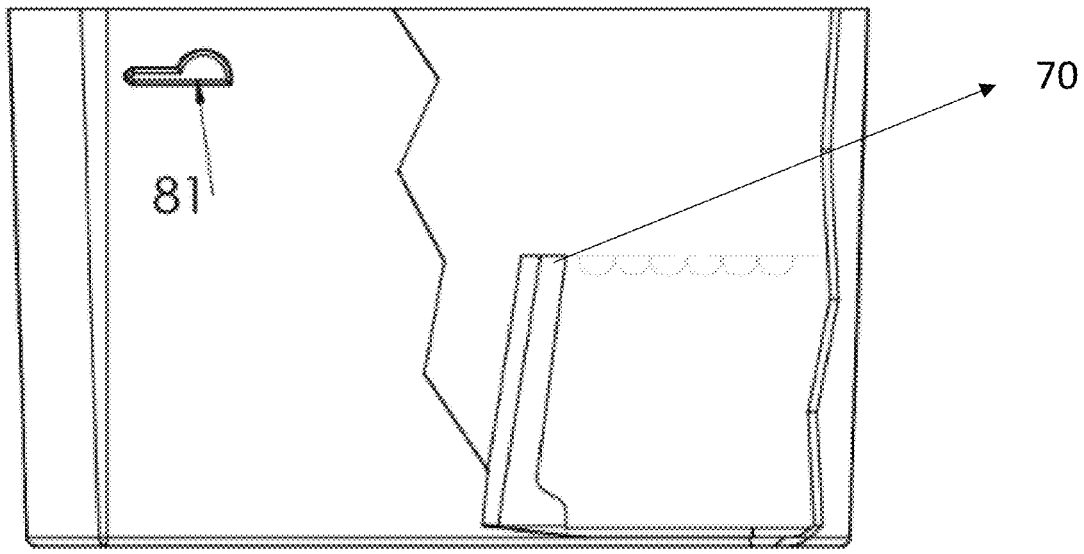

FIG. 6B is a front cutaway perspective looking into the toilet tank (80) showing the water dam device (10) placed within the tank such that water is dammed against the device and below the top portion (70) of the water dam device. Also shown is the toilet flush handle (81).

Figure 6C:
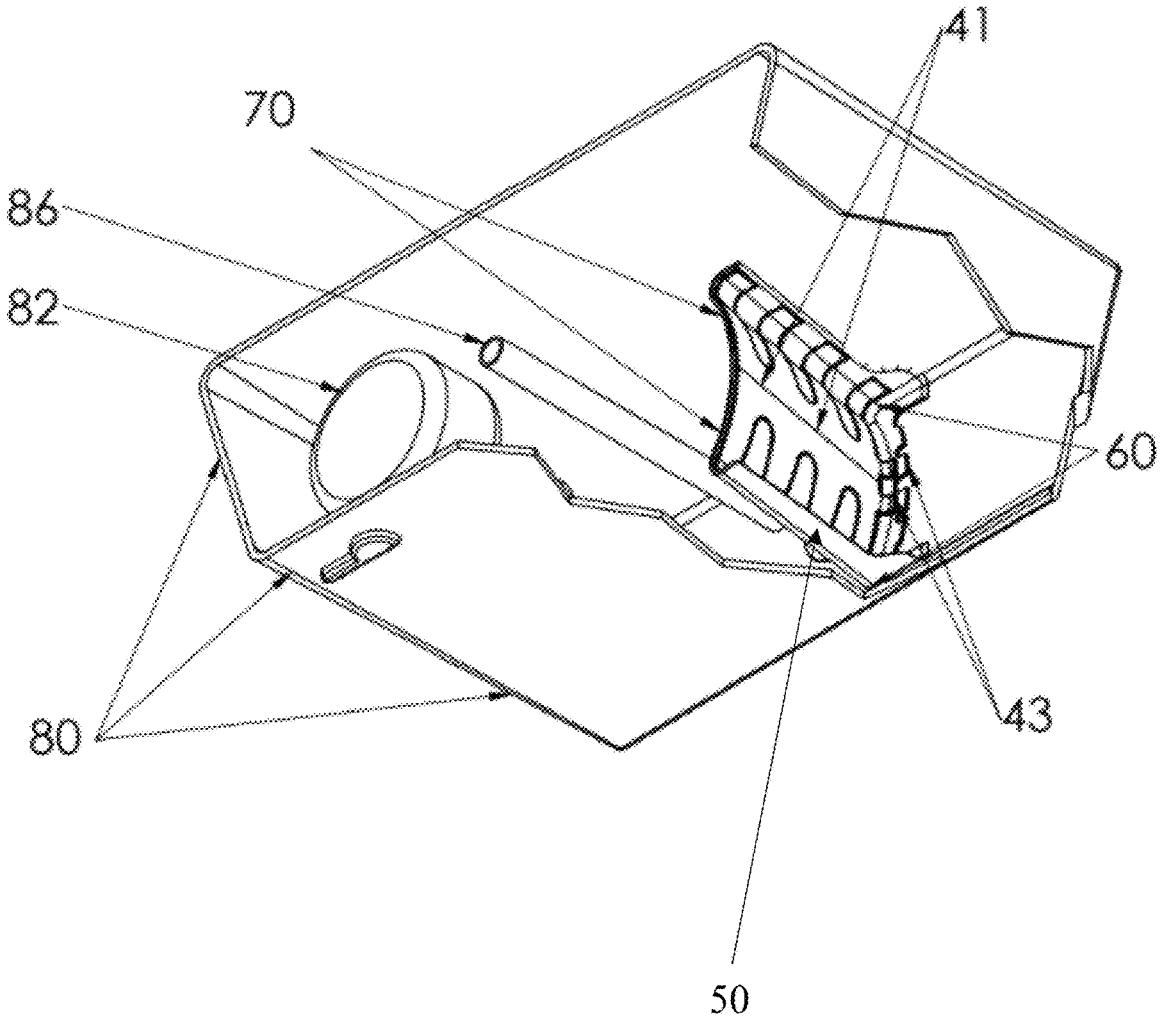

FIG. 6C is an angled top perspective of the water dam device (10) placed in a toilet tank (80) and as viewed from above and at an angle. The water dam device is situated into the tank such that the top (70) sits below the top of the water line, the feet (43) sit at the bottom of the tank and the sides (50) are against the sides of the tank. The design and material of the water dam device, more specifically the pliable casement (20) and the skeleton (40) (See FIG. 3A), enable the device to have flexibility to accommodate variations in distance between the sides of the tank while providing structure and rigidity to hold back water in one portion of the tank. Also shown are parts of a toilet tank, specifically the fill valve (82) and overflow tube (86).

III. Methods of Manufacture

The device is specially molded by forming a skeleton (40) using talc filled polypropylene and then injection molding a pliable casement (20) of thermoplastic elastomer (TPE) around the skeleton. The skeleton (40) includes a vertical pillar (41) with horizontal extension extending towards a side of the device (42) and vertical extensions extending toward the bottom of the device (43). The pliable casement (20) forms the top (70), base portion (30) and sides (50) of the device. The TPE is relatively soft and pliable and nicely suited to be immersed in water for extended periods, and the filled polypropylene material is designed to bend and flex to create the mechanical interface with the wall of the tank.

The skeleton (40) (which includes the vertical pillar (41), the horizontal extensions from the pillar (42) and the vertical extension from the pillar (also referred to as feet) (43)) are formed of filled polypropylene. Alternatively, the skeleton may be made of polyethylene or polyamide. The filled polypropylene may be about 10% to about 40% filled. In some embodiments, the skeleton is composed of talc filled polypropylene. In some embodiments, the skeleton is composed of 20% talc filled polypropylene.

The casement (20), base portion (30), sides (50), and top (70) are composed of thermoplastic elastomer (TPE). The TPE can range in hardness from 40 A to 80 A as measured by a durometer using the Shore A range. In an embodiment, the hardness is 55 A as measured by a durometer using the Shore A range. Alternatively, the casement and bottom portion may be made of EPDM rubber.

The device may be formed using an over-molding procedure. For example, the skeleton is molded with filled polypropylene material, and then placed into a second mold. Hot TPE is injected or poured over the skeleton within the second mold. The hot TPE creates a chemical bond at the interface with the polypropylene. The resulting unit exhibits a flexible, pliable casement unit with a firmer structured skeleton. The device is capable of forming an interference fit or static seal against the walls and bottom of the toilet tank wall without collapsing and without deteriorating from exposure to the water. The dam device "walls" a certain amount of water back from escaping through the flapper valve.

The device could alternatively be manufactured using spring steel for the skeleton and EPDM rubber for the casement. In this embodiment, the manufacture process would be stamped.

IV. Methods of Use

Referring to FIG. 1, normal use of a toilet (80) requires flushing. Once you push the handle arm (81) down, a chain that is connected to the flapper (88) and flush valve (87) is pulled up by the handle arm (81). By lifting the flapper up (88), the water inside the tank is actuated to flow down into the toilet bowl through the drain hole (89). This is achieved by gravitational weight and doesn't actually require the entire water volume of the toilet tank. As the water leaves the tank and enters the bowl, it fills the toilet bowl and the siphon effect occurs, resulting in removal of water and waste. As the tank is emptied, the flapper (88) covers the drain hole (89) and water comes into the tank through the fill valve (82) to refill it.

In some toilet tanks, there is a float ball. The float ball (85) is connected to the fill valve (82) that controls the water flow to the tank. When the water reaches a certain level in the tank, the ball (85) floats level on the water, shutting off the refilling mechanism. When the tank is empty, the float ball (85) falls freely allowing the valve (82) to open, filling the tank. In toilet tanks without a float ball, the function is achieved by a vertical shut off valve. In tanks with float balls, the float ball actuates the shut off valve, while in newer tanks, the vertical designs have a shut off valve integrated into the newer units The refill tube (83) and overflow tube (86) work together to help keep water in the tank. The overflow tube (86) empties directly into the toilet bowl below, refilling the bowl after a flush. The flapper (88) is a rubber mechanism that acts as a seal to the drain hole (89). It both lets water in and out of the tank when it is flushed.

The full volume of water in the toilet tank is not required to evacuate the bowl. The full volume of water is required only to provide gravity force for emptying the water from the tank. This means that a percentage of the water in the toilet tank can be reserved ("dammed" back) or displaced without compromising the efficiency or effectiveness of the toilet.

In use, the water dam device (10) is placed within a portion of a toilet tank (80) oriented in such a way that the bottom (30) is placed on the bottom of the tank with the sides (50) along opposite walls of the tank and the entire device perpendicular to the front and back walls of the tank. Referring to FIGS. 6A and 6C, the entire device is placed to one side of the toilet fill valve (82), the overflow tube (86), and the flapper (88).

In a toilet with a water dam device positioned as described above, once one pushes the handle (81), a chain that is connected to the flapper (88) and flush valve (87) is pulled up by the handle arm (81). By actuating the flapper up (88), the water inside the tank escapes down into the toilet bowl through the drain hole (89). The interference fit (static seal) of the water dam prevents the entire volume of the tank from emptying. Rather, about 40% of the volume of the tank is held back by the water dam device, thereby saving water with every flush. Referring to FIG. 6B, the perspective shows during a flush and emptying of the tank, the water line is just below the water dam device. As the tank is emptied, the flapper (88) covers the drain hole (89) and water refills the tank through the fill valve (82). With the water dam device in place, much less water is required to refill the tank. With every refill, a certain amount of new water comingles with the water held back by the device, thereby refreshing the water and preventing mold or bacteria from growing.

The design of the water dam is a combination of a flexible casement, which bows and flexes within the confines of a wide range of toilet tank sizes and designs, and a skeleton, which is engineered to provide structure to the device so that it doesn't collapse against the weight of the water. The device is designed to withstand water exposure for the life of the toilet. The water dam device is easy to install, and requires no maintenance or cleaning. A user simply installs the water dam device in the toilet tank, positioning it so that it does not interfere with the toilet flapper valve or other mechanisms. Once the water dam device is installed, it will "dam" back as much as 4 liters of water per flush.

The water dam device is designed to create a wedge fit "dam" in most conventional toilet tanks, which will hold back as much as 4 liters of water per flush. The water dam device is a flexible, pliable product that is designed to have an interference fit (static seal) into the majority of toilet tanks primarily designed and produced prior to 1992. It also will fit into the majority of newer "low flow" toilets.

The water dam device is easily installed by bowing and flexing the unit as it is immersed into the toilet tank (the tank does not have to be drained). The device is pliable enough to fit around existing plumbing mechanisms, and still seat with a secure seal "fit" against the wall and base of the toilet tank. The combination of the pliability (deflective capability) and hardness paired with adequate force creates a static "seal" between the two, whereupon the seal prevents media from traveling between the two surfaces. The tack is achieved when the elastomeric material deflects and conforms to the mating surface such that it becomes static in position the water dam device described herein is designed to create a full static seal by virtue of the force applied over the perimeter by the polypropylene skeleton, and the pliability of the TPE material to conform to the dimensional and surface variants of the porcelain tank.

The water dam device may be more effective with the more modern "vertical" inlet valves, but will also work with older systems that use a float ball. The water dam device will then "dam" back a percentage of the tank water with every flush, but the action of the toilet will not be compromised. The water dam device is designed to be just below the normal height of the water in the tank, so that when the tank refills after a flush, the water will repopulate with the fresh water coming into the tank, and not become stagnant over time.

The contents of all reference(s), patent(s), and patent application publication(s) cited in this application are hereby incorporated by reference in their entireties.

What is claimed is:

1. A water dam device, comprising:

a skeleton comprising a first material; and a pliable casement molded to the skeleton and comprising a second material, wherein tack of the second material is greater than tack of the first material, the pliable casement comprising:

a base portion, a first side, and a second side capable of forming an interference fit with a bottom, a front wall, and a back wall, respectively, of a toilet tank, the toilet tank comprising the bottom, the front wall, and the back wall; and further wherein the skeleton comprises:

a vertical pillar extending from a top portion to the base portion of the pliable casement;

a plurality of horizontal extensions from the vertical pillar towards at least one of the first side and the second side of the pliable casement; and a plurality of vertical extensions from the vertical pillar towards the base portion.

2. The water dam device of claim 1, wherein the device comprises a front face and a back face, wherein when the device is placed in a toilet tank the front face is oriented in the toilet tank towards retained water and the back face is oriented in the toilet tank towards a flush valve in the toilet tank.

3. The water dam device of claim 1, further comprising a top portion, wherein when the device is placed in a toilet tank, the top portion is a distance below a waterline in the toilet tank.

4. A water dam device comprising:

a skeleton comprising a first material; and a pliable casement molded to the skeleton, and a front face and a back face; and wherein the pliable casement comprises a second material, wherein tack of the second material is greater than tack of the first material, the pliable casement comprising:

a base portion, wherein the base portion comprises a plurality of cut-outs extending towards the front face of the water dam device, a first side, and a second side capable of forming an interference fit with a bottom, a front wall, and a back wall, respectively, of a toilet tank, the toilet tank comprising the bottom, the front wall, and the back wall; and wherein when the device is placed in a toilet tank the front face is oriented in the toilet tank towards retained water and the back face is oriented in the toilet tank towards a flush valve in the toilet tank.

5. The water dam device of claim 1, wherein the first material comprises a filled polypropylene.

6. The water dam device of claim 5, wherein the filled polypropylene is talc filled polypropylene.

7. The water dam device of claim 6, wherein the filled polypropylene is about 10% to about 40% talc filled polypropylene.

8. The water dam device of claim 7, wherein the filled polypropylene is about 20% talc filled polypropylene.

9. The water dam device of claim 1, wherein the second material comprises a thermoplastic elastomer (TPE).

10. The water dam device of claim 9, wherein the TPE has a hardness as measured by a durometer of about 20 to about 80 A according to the Shore A scale.

11. The water dam device of claim 10, wherein the TPE has a hardness as measured by a durometer of about 55 A according to the Shore A scale.

12. The water dam device of claim 1, wherein the base portion comprises a contoured edge.

13. The water dam device of claim 12, wherein the contoured edge comprises a radial arc proximate to the first side and/or a radial arc proximate to the second side.

14. A method of manufacturing a water dam device, comprising:

forming a skeleton comprising a vertical pillar extending from a top portion to a base portion, a plurality of horizontal extensions, and a plurality of vertical extensions from the vertical pillar;

injection molding a pliable casement around the skeleton, the pliable casement comprising a base portion, a first side, and a second side capable of forming an interference fit with a bottom, a front wall, and a back wall, respectively, of a toilet tank, the toilet tank comprising the bottom, the front wall, and the back wall;

wherein the skeleton comprises a first material, wherein the pliable casement comprises a second material, and wherein tack of the second material is greater than tack of the first material.

15. The method of claim 14, wherein the first material comprises a filled polypropylene, and wherein the second material comprises a thermoplastic elastomer.

16. A method of damming water in a toilet tank, the method comprising:

fitting a water dam device in a toilet tank, the water dam device comprising:

a skeleton, the skeleton comprising a first material, and a pliable casement molded to the skeleton, the pliable casement comprising a second material, wherein tack of the second material is greater than tack of the first material, the pliable casement comprising a base portion, a first side, and a second side; and further wherein the skeleton comprises:

a vertical pillar extending from a top portion to the base portion;

a plurality of horizontal extensions from the vertical pillar towards at least one of the first side and the second side; and a plurality of vertical extensions from the vertical pillar towards the base portion.

17. The method of claim 16, wherein fitting the water dam device in the toilet tank comprises:

orienting a front face of the water dam device towards retained water;

orienting a back face of the water dam device towards a flush valve in the toilet tank; and forming an interference fit of the base portion, the first side, and the second side of the pliable casement with the bottom, the front wall, and the back wall, respectively, of the toilet tank.

18. The method of claim 16, wherein the first material comprises a filled polypropylene, and wherein the second material comprises a thermoplastic elastomer.

19. A method of damming water in a toilet tank, the method comprising:

fitting a water dam device in a toilet tank, the water dam device comprising:

a skeleton, the skeleton comprising a first material; and a pliable casement molded to the skeleton, and a front face and a back face; and wherein the pliable casement comprises a second material, wherein tack of the second material is greater than tack of the first material, the pliable casement comprising:

a base portion, wherein the base portion comprises a plurality of cut-outs extending towards the front face of the water dam device, a first side, and a second side capable of forming an interference fit with a bottom, a front wall, and a back wall, respectively, of a toilet tank, the toilet tank comprising the bottom, the front wall, and the back wall; and wherein when the device is placed in a toilet tank, the front face is oriented in the toilet tank towards retained water and the back face is oriented in the toilet tank towards a flush valve in the toilet tank.

20. The method of claim 19, wherein fitting the water dam device in the toilet tank comprises:

orienting the front face of the water dam device towards retained water; and orienting the back face of the water dam device towards a flush valve in the toilet tank.

21. The method of claim 20, wherein the first material comprises a filled polypropylene, and wherein the second material comprises a thermoplastic elastomer.

* * * * *